US008177075B2

(12) United States Patent
Hathorn

(10) Patent No.: US 8,177,075 B2
(45) Date of Patent: May 15, 2012

(54) METHOD FOR STORING SANDALS AND OTHER LOOSE ITEMS

(76) Inventor: Mary Ellen Hathorn, Lafayette, LA (US)

( * ) Notice: Subject to any disclaimer, the term of this patent is extended or adjusted under 35 U.S.C. 154(b) by 0 days.

(21) Appl. No.: 12/931,424

(22) Filed: Feb. 1, 2011

(65) Prior Publication Data

US 2011/0120961 A1 May 26, 2011

(51) Int. Cl.
*A47F 7/08* (2006.01)

(52) U.S. Cl. ..... 211/34; 211/85.3; 211/113; 223/85; 24/302

(58) Field of Classification Search ..... 211/34, 211/35, 85.3, 85.2, 38, 113, 119, 119.009; 24/302; 223/DIG. 1, 85, 88, 89–91; D6/328
See application file for complete search history.

(56) References Cited

U.S. PATENT DOCUMENTS

D47,797 S * 9/1915 Saunders ..... D4/468
3,323,186 A * 6/1967 Rennert ..... 410/116
3,414,943 A * 12/1968 Hattori ..... 24/200
5,426,829 A * 6/1995 Hsiung ..... 24/197
5,584,455 A * 12/1996 Artemi ..... 248/214
5,600,875 A * 2/1997 Chang ..... 24/200
5,931,314 A * 8/1999 Jackstat et al. ..... 211/34
6,038,745 A * 3/2000 Rapp ..... 24/68 R
6,595,355 B1 * 7/2003 Hooper ..... 206/292
D566,405 S * 4/2008 Belokin ..... D6/315
D578,312 S * 10/2008 Belokin ..... D6/315
7,445,127 B2 * 11/2008 Pittman ..... 211/35
D582,686 S * 12/2008 Belokin ..... D6/315
2003/0222040 A1 * 12/2003 Boysen ..... 211/96
2007/0080121 A1 * 4/2007 Pittman ..... 211/35
2007/0119881 A1 * 5/2007 Murphy ..... 223/97
2007/0251894 A1 * 11/2007 Kelley ..... 211/34
2008/0142460 A1 * 6/2008 Belokin et al. ..... 211/113

* cited by examiner

*Primary Examiner* — Darnell Jayne
*Assistant Examiner* — Devin Barnett
(74) *Attorney, Agent, or Firm* — Ted M. Anthony

(57) ABSTRACT

A method for storing and displaying footwear including, without limitation, flip-flops and thong-type sandals, as well as other loose items, is provided. An elongate central body, such as a length of ribbon or other similar structure, having a number of upwardly facing hooks—typically combined in pairs—arrayed along the length of the central body, is suspended from a support. Sandals and other loose items are hung on the hooks.

3 Claims, 3 Drawing Sheets

METHOD FOR STORING SANDALS AND OTHER LOOSE ITEMS

CROSS REFERENCES TO RELATED APPLICATION

Priority of U.S. Provisional Patent Application Ser. No. 60/993,558 filed Sep. 14, 2007, and U.S. Non-Provisional patent Application Ser. No. 12/077,583, currently pending, both incorporated herein by reference, is hereby claimed.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a method for using an apparatus for storing and displaying footwear and other loose items. More particularly, the present invention pertains to a method for using an apparatus for storing and displaying strapped footwear including, but not necessarily limited to, flip-flops and thong-type sandals, as well as other loose items.

2. Brief Description of the Prior Art

Flip-flops or thong sandals are typically backless sandals having a substantially planar sole that is held loosely on a user's foot by straps. In most cases, the straps of a flip-flop sandal comprise two simple straps that come together to form a "Y" shape. Each of said straps are typically anchored to the sole along both the sides of a user's foot, extend over the top of said foot, and converge together where they are joined. Such combined straps are then anchored to the sole between the user's first (big) toe and next (second) toe. Some thong-type sandals also have other straps, and many different additions and/or variations of strap styles and configurations are also possible.

Although basic thong sandals typically have a flat sole, such thong sandals can also come in a variety of styles such as heels, slides, wedges, and/or "kitten heels." Thong sandals can be constructed from rubber or other relatively inexpensive materials, while dressier versions can be made from leather, suede, patent leather, and/or other materials. Depending upon prevailing fashion, thong sandals are also sometimes embellished with accessories including, but not limited to, buckles, jewelry, fringes, medallions and/or beading. Because of the popularity of thong sandals as dress shoes, some hosiery manufacturers even make stockings with a gap between the first and second toes to accommodate thong straps.

Organization and storage of flip-flops, thong sandals and other similar footwear can present challenges. Due to the unusual shape and configuration of such footwear including, without limitation, the lack of regular "uppers," such footwear generally cannot be stored using conventional shoe trees and/or other existing footwear storage devices. Moreover, one member of a pair can become easily lost or misplaced, which renders the remaining member of such pair less desirable and, in some cases, useless.

Although particularly well suited for use with footwear such as thong-type sandals and the like, the apparatus of the present invention can also be used to conveniently store, organize and/or display other items. By way of illustration, but not limitation, the apparatus of the present invention can be used to beneficially hold loose items such as children's toys, stuffed animals and the like. For example, stuffed animals and/or similar toys such as Beanie Babies® or Webkinz® can be efficiently stored and displayed on the apparatus of the present invention. Said toys can be maintained in a convenient location to prevent them from becoming lost or misplaced, while permitting display of such toys during periods when they are not in use.

In light of the foregoing, there is a need for a convenient, inexpensive and user-friendly device for storing flip-flops, thong sandals and other similar footwear, as well as other loose items. The device should permit the storage and display of such items and, particularly in the case of footwear, should facilitate storage of such footwear in matching pairs. Further, the device should be capable of being used in multiple locations including, without limitation, on coat hangers (such as on support rods in closets or similar enclosures), or on hooks attached to walls, doors or other convenient surfaces.

SUMMARY OF THE PRESENT INVENTION

The present invention comprises an elongate central body member. In the preferred embodiment, said elongate central body member is flexible, yet sufficiently strong to support the weight of multiple pairs of flip-flops, thong sandals or other similar footwear. By way of example, but not limitation, said elongate central body member can be a length of ribbon, strap or other similar material. A mounting means, such as a loop or "d-clamp", is disposed at one end of said elongate central body member.

At lease one hanger member is attached to such elongate central body member. In the preferred embodiment of the present invention, each such hanger member comprises a substantially flat body section having a first end, a second end, and a length. A first hook is disposed at said first end of said hanger member, while a second hook is disposed at said second end of said hanger member. In the preferred embodiment of the present invention, said first and second hooks are oriented in the same direction; that is, the mouths or openings of said first and second hooks are both facing in substantially the same direction (which, in most cases, will be vertically upward when the central body member of the present invention is mounted).

Said hanger members are disposed along the length of said elongate central body member in spaced relationship. Further, in the preferred embodiment of the present invention, said hanger members are affixed to such elongate central body member so that the longitudinal axis of the body section of each such hanger member is oriented substantially perpendicular to the longitudinal axis of said elongate central member. In this configuration, each hanger member essentially forms a pair of aligned hooks; one such hook is laterally disposed on one side of said elongate central member, while the other such hook is laterally disposed on the opposite side of said elongate central member.

In operation, the mounting means of said elongate central body member is typically attached to a clothes hanger, hook or other stationary member, while said elongate central body member is permitted to hang vertically. In this configuration, said clothes hanger, hook or other stationary member can hang from a convenient support surface (such as, for example, a rod in a closet). Multiple pairs of aligned hooks (formed by said hanger members positioned in spaced relationship along the length of said elongate central body member) are disposed at different points along said elongate central body member. Said hanger members are oriented so that all of the openings of said hooks face substantially upward.

Flip-flops, thong sandals or other similar footwear can be hung on said hooks for storage until needed for later use. Because said hooks are disposed in pairs, one piece of footwear can be hung on one hook, while the other matching piece of footwear can be hung on the other matching hook. In other words, both pieces of footwear can be kept together and conveniently stored in close proximity to one another.

The present invention has a number of advantages, and can be beneficially utilized in a number of different applications. For ease of reference, the present invention is described herein primarily in connection with applications involving footwear, and especially "flip-flops" or thong-type sandals. However, the description set forth herein is for illustration purposes only, and is not intended to limit or otherwise restrict the scope of the present invention in any way. Although the present invention is primarily described herein in connection with the storage and display of footwear, it is to be observed that the present invention can be used with a multitude of other items including, but not necessarily limited to, stuffed animals and the like.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

The present invention has a number of advantages, and can be beneficially utilized in a number of different applications. For ease of reference, the present invention is described herein primarily in connection with applications involving footwear, and especially "flip-flops" or thong-type sandals. However, the description set forth herein is for illustration purposes only, and is not intended to limit or otherwise restrict the scope of the present invention in any way. For illustration purposes, the present invention is described in connection with the storage and display of footwear; however, it is to be observed that the present invention can be used with a multitude of other loose objects including, but not necessarily limited to, stuffed animals and the like.

Figure 1:
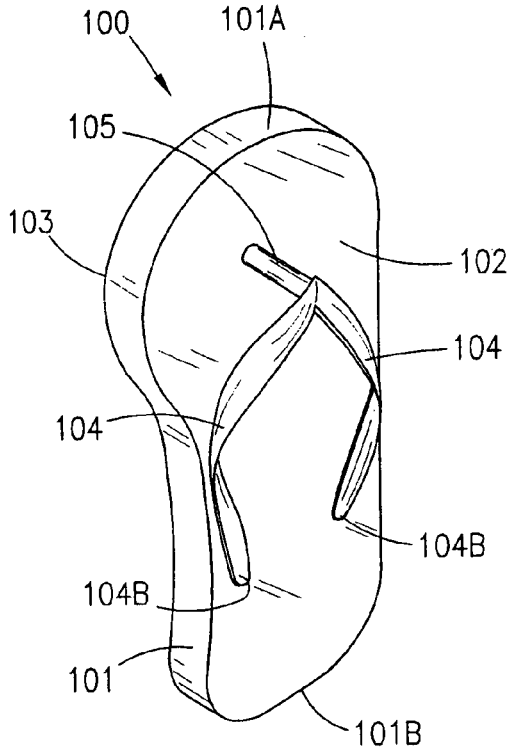
Fig. 1 PRIOR ART
FIG. 1 depicts a side perspective view of a prior art thong-type sandal.

Referring to the drawings, FIG. 1 depicts a side perspective view of a prior art thong-type sandal 100. It is to be observed that thong-type sandals such as sandal 100 are usually produced in pairs; that is, one sandal for a right foot and a matching sandal for a left foot. Prior art sandal 100 depicted herein is provided merely for illustration purposes as an example of an existing sandal design. Sandal 100 is just one of the many different types, styles and/or configurations of footwear that can be beneficially used in connection with the mounting apparatus of the present invention.

Still referring to FIG. 1, sandal 100 generally comprises sole 101 having substantially planar upper surface 102 and substantially planar lower surface 103 (obscured from view in FIG. 1). Planar lower surface 103 of sole 101 may be smooth, or may include treads, protrusions or other traction-promoting means well known in the art. Similarly, upper surface 102 of sole 101 may be smooth, or may include indentations or recesses designed to conform to the curvature of a user's foot. Further, upper surface 102 of sole 101 may also optionally include other features well known in the art including, but not necessarily limited to, protrusions, massaging elements and/or gripping features.

It is to be observed that prior art sandal 100 has substantially flat sole member 100. Many different styles of prior art sandals, such as sandal 100, have no significant change in sole thickness. However, although not depicted as such in FIG. 1, sole 101 of prior art sandal 100 can be thicker at back end 101B than at front end 101A, thereby defining an elevated heel section at back end 101B.

Still referring to FIG. 1, sandal 100 has straps 104 that create a substantially "Y-shaped" structure extending along a portion of upper surface 102 of sandal 100. Said straps 104 of prior art sandal 100 connect to sole 101 at their respective ends 104B. Although said ends 104B of straps 104 can connect to sole 101 at many different locations, in the particular style of prior art sandal 100 depicted in FIG. 1, said straps connect to said sole 101 near the sides of sole 101, and closer to back end 101B than front end 101A.

In the style of prior art sandal 100 depicted in FIG. 1, straps 104 converge together and form anchor member 105. Said anchor member 105 is connected to sole 101. Although precise placement of anchor member 105 relative to sole 101 can be varied to account for different sizes and shapes of feet, as well as style preferences, in most cases anchor member 105 is positioned where it will fit comfortably between a typical user's (not depicted in FIG. 1) first (big) toe and next (second) toe. Further, straps 104 are frequently oriented so that they extend from both sides of a user's foot, converge over the top of such foot, and combine to form anchor member 105.

Figure 2:
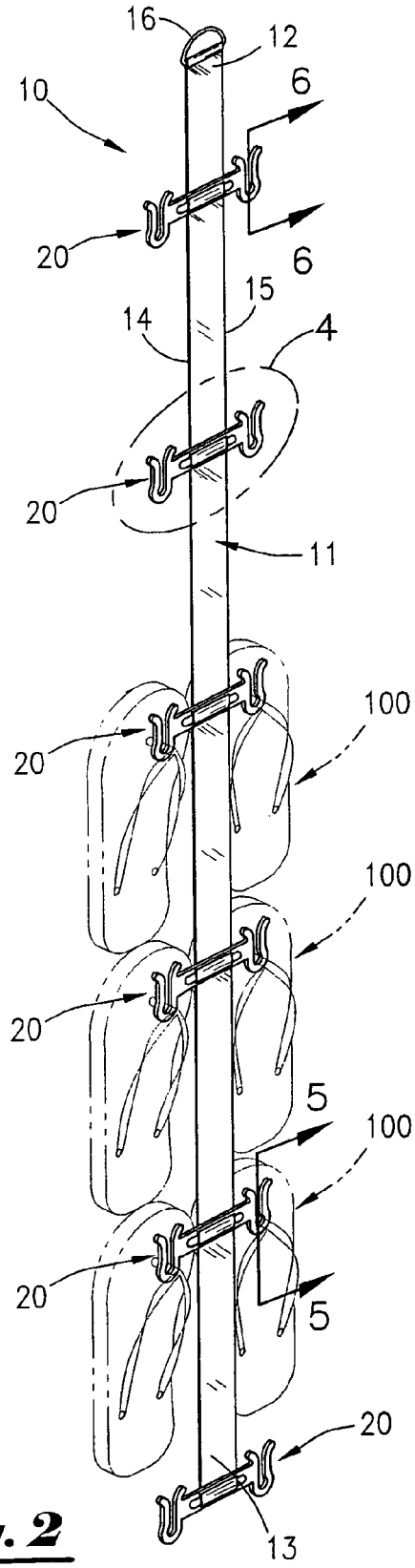
FIG. 2 depicts a side perspective view of the mounting apparatus of the present invention.

Referring to FIG. 2, mounting apparatus 10 of the present invention comprises an elongate central body member 11. In the preferred embodiment, said elongate central body member 11 has top 12, bottom 13, first side 14 and second side 15. Said elongate central member 11 is flexible, yet sufficiently strong to support the weight of multiple pairs of sandals or other similar footwear (such as, for example, prior art sandal 100 depicted in FIG. 1). By way of example, but not limitation, said elongate central body member 11 can be fashioned from a length of ribbon, strap, leather or other natural or synthetic material(s) having desired characteristics. In the preferred embodiment, d-clamp 16 is disposed at top 12 of said elongate central body member 11. Still referring to FIG. 2, a plurality of hanger members 20 is attached to elongate central body member 11.

Figure 3:
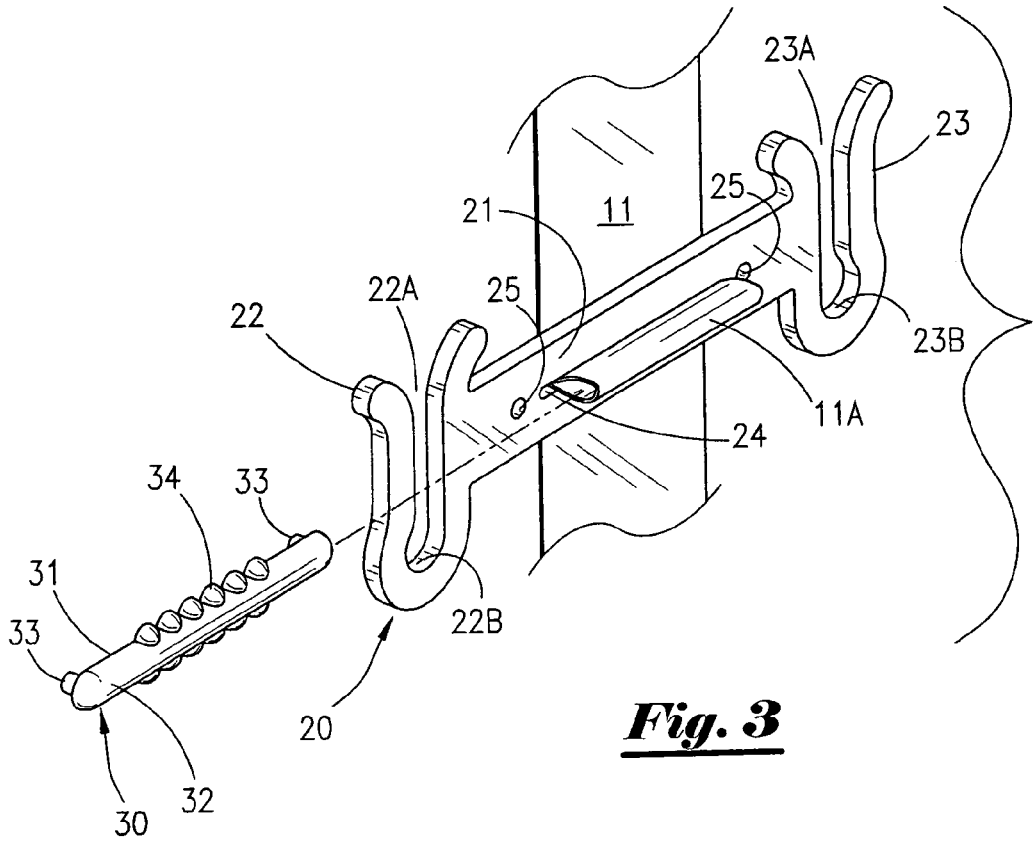
FIG. 3 depicts an exploded perspective view of a hanger member and elongate central member of the present invention.

FIG. 3 depicts an exploded perspective view of a hanger member 20 of the present invention. In the preferred embodiment of the present invention, each such hanger member 20 comprises a substantially flat body section 21. A first hook 22 is disposed at one end of said flat body section 21 of said hanger member 20, while a second hook 23 is disposed at the opposite end of said flat body section 21 of said hanger member 20. Hook 22 defines an upper opening 22A providing access to concave surface 22B, while hook 23 similarly defines an upper opening 23A providing access to concave surface 23B. In the preferred embodiment of the present invention, said hooks 22 and 23 are oriented in the same direction; that is, concave surfaces 22B and 23B of hooks 22 and 23, respectively, are both facing in substantially the same direction.

Referring back to FIG. 2, said hanger members 20 are disposed in spaced relation at desired positions along the length of said elongate central body member 11. Further, in the preferred embodiment of the present invention, said hanger members 20 are affixed to said elongate central member 11 so that the longitudinal axis of the body section 21 of each such hanger member 20 is oriented substantially perpendicular to the longitudinal axis of said elongate central member 11. In the preferred embodiment, body section 21 of hanger member 20 is beneficially sized to be slightly longer than the width of elongate body member 11, thereby permitting hooks 22 and 23 to be laterally disposed along both sides of said elongate central member 11.

In this configuration, each hanger member 20 essentially forms a pair of laterally aligned hooks; one such hook from each such pair is disposed along side 14 of said elongate central member 11, while the other hook from such pair is disposed along side 15 of said elongate central member 11. Said hanger members 20 can be affixed to elongate central body member 11 using any number of different fastening means including, but not necessarily limited to, conventional rivets or fasteners.

FIG. 3 depicts how hanger member 20 is affixed to elongate central member 11 in the preferred embodiment of the present invention. Referring to FIG. 3, in the preferred embodiment of the present invention each hanger member 20 has elongate slot 24. Said elongate slot 24 extends through body section 21 of hanger member 20; the longitudinal axis of elongate slot 24 is beneficially oriented in parallel relationship with the longitudinal axis of body section 21, and in perpendicular relationship with the longitudinal axis of elongate central member 11. In the preferred embodiment, the length of said elongate slot 24 is slightly larger than the width of elongate central member 11 (that is, the length of elongate slot 24 is slightly greater than the distance between side 14 and side 15 of said elongate central member 11). At least one snap aperture 25 is disposed at each end of elongate slot 24.

Still referring to FIG. 3, locking bracket 30 is provided to facilitate attachment of hanger member 20 to elongate central body member 11. Specifically, in the preferred embodiment, locking bracket 30 has flat side 31 and curved side 32 that defines a substantially convex outer surface. Snap extensions 33 extend from flat side 31 and are spaced so that they align and can mate with snap apertures 25 of hanger member 20. In the preferred embodiment, locking bracket 30 also has a plurality of friction-promoting gripping teeth 34 disposed on its upper and lower surfaces.

Hanger member 20 can be beneficially affixed to elongate central member 11 using locking bracket 30. Specifically, a portion of elongate central member 11 is passed through elongate slot 24 of hanger member 20, thereby forming loop 11A. Locking bracket 30 is inserted into said loop 11A, and snap extensions 33 are inserted into snap apertures 25. In the preferred embodiment, snap extensions 33 are sized and configured to provide a frictional connection when inserted within snap apertures 25 so that locking bracket 30 can be removably attached to hanger member 20.

Figure 4:
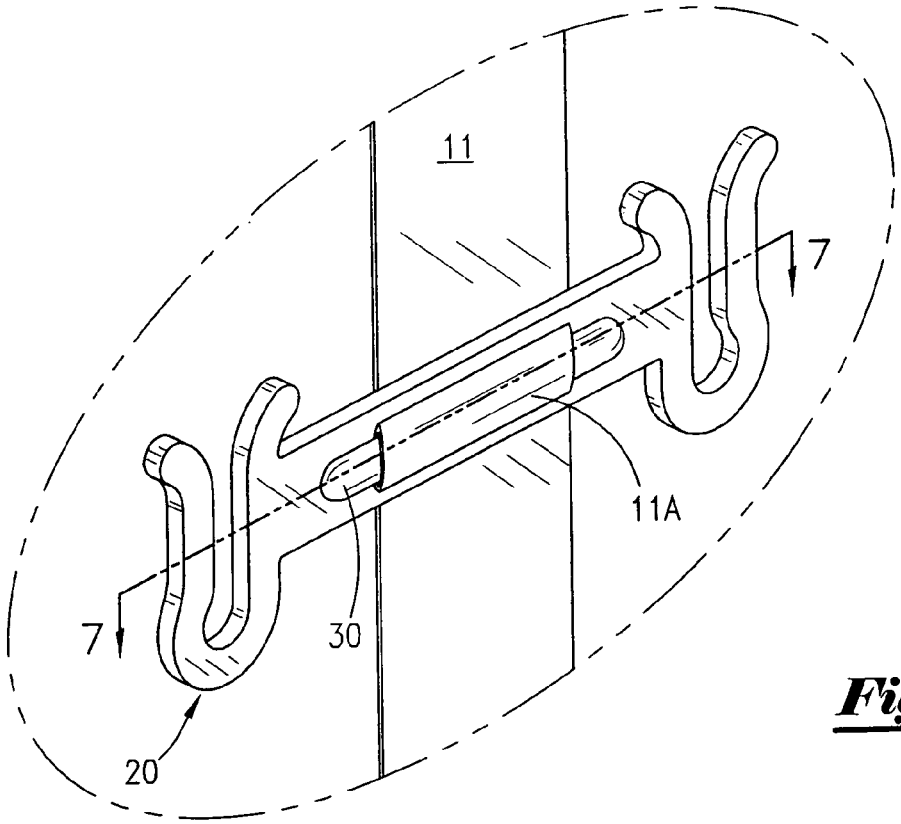
FIG. 4 depicts a detailed side perspective view of a highlighted portion of the present invention depicted in FIG. 2.

FIG. 4 depicts a detailed side perspective view of a highlighted portion of the present invention depicted in FIG. 2. As described above, loop 11A, formed by a portion of elongate central member 11, is inserted through elongate slot 24 of hanger member 20. Locking bracket 30 is inserted laterally within said loop 11A, and snap extensions 33 are locked in place within snap apertures 25. In the preferred embodiment, elongate central member 11 should be pulled tight so that loop 11A is taut around locking bracket 30. Although not visible in FIG. 4, gripping teeth 34 of locking bracket 30 act frictionally act against the inner surface of loop 11A, thereby securing hanger member 20 in place and preventing slippage of said hanger member 20 along the length of elongate central member 11.

In this manner, a plurality of hanger members 20 can be affixed or anchored to elongate central member 11. Further, use of locking bracket 30 permits said hanger members 20 to be easily and conveniently affixed, removed, and then reaffixed at different locations along the length of said elongate central member 11. As such, it is to be observed that said hanger members 20 can be adjustably positioned along the length of elongate central member 11 to accommodate sizes, shapes, styles and/or other characteristics of the footwear of other items to be supported by the present invention.

Figure 6:
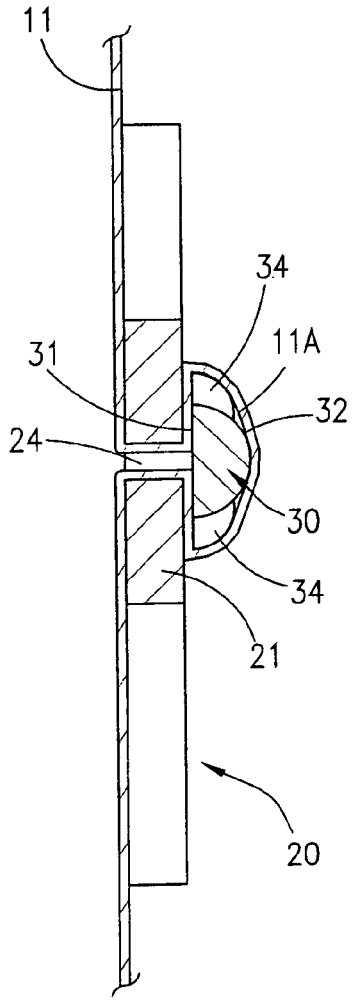
FIG. 6 depicts a side sectional view of the present invention along line 6-6 of FIG. 2.

FIG. 6 depicts a side sectional view of the present invention along line 6-6 of FIG. 1. Loop 11A, formed by a portion of elongate central member 11, extends through elongate slot 24 of hanger member 20. Locking bracket 30 is inserted laterally within loop 11A. Elongate central member 11 is pulled tight so that loop 11A is taut around the convex outer surface of curved side 32 locking bracket 30. Flat surface 31 of locking bracket 30 acts to wedge a portion of loop 11A against body section 21 of hanger member 20. Gripping teeth 34 of locking bracket 30 frictionally act against the inner surface of loop 11A, thereby securing hanger member 20 in place and preventing slippage of said hanger member 20 along the longitudinal axis of elongate central member 11.

Figure 7:
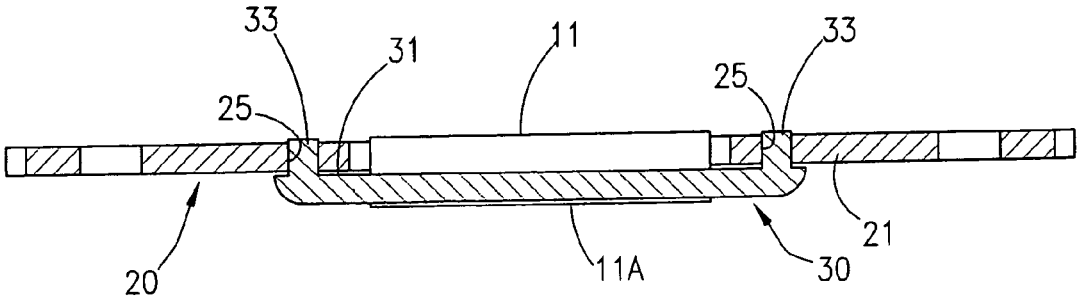
FIG. 7 depicts a side sectional view of the present invention along line 7-7 of FIG. 4.

FIG. 7 depicts a side sectional view of the present invention along line 7-7 of FIG. 4. Snap extensions 33 of locking bracket 30 are inserted into snap apertures 25 of hanger member 20. In the preferred embodiment, snap extensions 33 are sized to provide a frictional connection with snap apertures 25. Flat surface 31 of locking bracket 30 acts to wedge a portion of loop 11A against body section 21 of hanger member 20, and thereby hold said hanger member 20 in place.

Referring back to FIG. 2, in operation, clamp 16 of said elongate central body member 11 can be attached to a clothes hanger, hook or other stationary member, thereby permitting elongate central body member 11 to hang vertically from said clamp 16. In this configuration, multiple pairs of aligned hooks (formed by said hanger members 20 positioned in spaced relationship along the length of said elongate central body member 11) are disposed at different points along the length of said elongate central body member 11. Said hanger members 20 are oriented so that all of the concave surfaces of said hooks of such hanger members face substantially upward.

Still referring to FIG. 2, multiple pairs of sandals 100 (or other similar footwear) can be hung on said hooks of hanger members 20 for storage until needed for later use. Because said hooks are disposed in pairs, one sandal of a matching pair can be hung on one hook, while the accompanying (matching) sandal can be hung on the laterally aligned hook. In other words, both sandals of a matching pair can be kept organized together, and stored in close proximity to one another.

Figure 5:
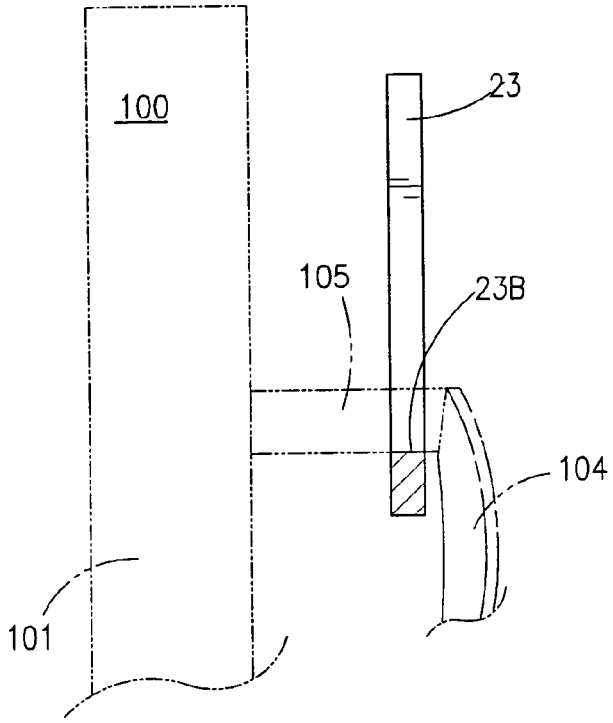
FIG. 5 depicts a side sectional view of the present invention along line 5-5 of FIG. 2.

FIG. 5 depicts a side sectional view of the mounting apparatus 10 of the present invention along line 5-5 of FIG. 2. When thong-type sandals are being stored on the mounting apparatus of the present invention, anchor member 105 of each such sandal 100 can be received upon upwardly facing hook 23 of the present invention. Specifically, such anchor member 105 rests upon upwardly facing concave surface 23B of hook 23. In this orientation, sandal 100 rests in substantially flat and orderly orientation relative to other sandals mounted in the same fashion on mounting apparatus 10. It is to be observed that mounting apparatus 10 of the present invention can also be used to hold/store many different styles of footwear including, without limitation, non-thong and Crocs® sandals.

It is to be observed that portions of central body member 11 and hanger members 20 can provide convenient surfaces for display of various designs or indicia. By way of illustration, but not limitation, cartoon characters, sporting team colors, logos, emblems and/or other designs can be displayed on such surfaces.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for organizing and storing sandals comprising the steps of:

a) attaching a mounting apparatus to a clothes hanger, wherein said mounting apparatus comprises:
   i) an elongate flexible central member having a first end, a second end, a length and a width;
   ii) a plurality of hanger members adjustably disposed along the length of said flexible elongate central member, each of said hanger members comprising:
      aa) a body section having a first end, a second end a length and at least one snap aperture disposed on said body section, wherein the length of said body section is greater than the width of said elongate central member, said body section is oriented substantially perpendicular to the longitudinal axis of said elongate central member, and said body section can be adjustably disposed along substantially the entire length of said elongate central member;
      bb) a first upwardly facing hook disposed at the first end of said body section;
      cc) a second upwardly facing hook disposed at the second end of said body section;
      dd) a slot extending through said body section for receiving a loop formed from a portion of said elongate flexible central member, wherein said slot runs substantially parallel to the length of said body section and is longer than the width of said elongate central member;
      ee) an elongate locking bracket disposed through said loop formed from a portion of said elongate flexible central member and attached to said body section; and
      ff) at least one snap extension disposed on said elongate locking bracket, wherein said at least one snap extension of said elongate locking bracket is aligned with said at least one snap aperture of said body section;

b) hanging said clothes hanger from a support member;

c) hanging a first sandal of a matching pair of sandals from a first hook of a hanger member; and d) hanging a second sandal from a matching pair of sandals from a second hook of a hanger member.

2. The method of claim 1, wherein said elongate locking bracket has at least one flat side.

3. The method of claim 1, wherein said elongate locking bracket has at least one gripping tooth disposed along the length of said elongate locking bracket.

* * * * *